US008520873B2

(12) United States Patent
Mahabub et al.

(10) Patent No.: US 8,520,873 B2
(45) Date of Patent: Aug. 27, 2013

(54) AUDIO SPATIALIZATION AND ENVIRONMENT SIMULATION

(76) Inventors: Jerry Mahabub, Littleton, CO (US); Stephan M. Bernsee, Mainz (DE); Gary Smith, Castle Rock, CO (US)

( * ) Notice: Subject to any disclaimer, the term of this patent is extended or adjusted under 35 U.S.C. 154(b) by 752 days.

(21) Appl. No.: 12/582,449

(22) Filed: Oct. 20, 2009

(65) Prior Publication Data

US 2010/0246831 A1 Sep. 30, 2010

Related U.S. Application Data

(60) Provisional application No. 61/106,872, filed on Oct. 20, 2008.

(51) Int. Cl.
*H04R 5/02* (2006.01)

(52) U.S. Cl.
USPC ..... 381/310; 381/1; 381/17

(58) Field of Classification Search
USPC ..... 381/1, 17, 26, 27, 77, 61, 74, 18, 381/92, 119, 303, 309, 310; 704/500; 382/100
See application file for complete search history.

(56) References Cited

U.S. PATENT DOCUMENTS

| | | | | |
|---|---|---|---|---|
| 5,500,900 | A | 3/1996 | Chen et al. | |
| 5,528,694 | A * | 6/1996 | Van De Kerkhof et al. | 381/27 |
| 5,751,817 | A | 5/1998 | Brungart | |
| 5,802,180 | A | 9/1998 | Abel et al. | |
| 5,943,427 | A | 8/1999 | Massie et al. | |
| 6,118,875 | A | 9/2000 | Moller et al. | |
| 6,498,856 | B1 | 12/2002 | Itabashi et al. | |
| 6,990,205 | B1 | 1/2006 | Chen | |
| 7,167,567 | B1 * | 1/2007 | Sibbald et al. | 381/17 |
| 7,382,885 | B1 * | 6/2008 | Kim et al. | 381/17 |
| 2004/0196994 | A1 | 10/2004 | Kates | |
| 2004/0247144 | A1 | 12/2004 | Nelson et al. | |
| 2005/0117762 | A1 * | 6/2005 | Sakurai et al. | 381/309 |
| 2005/0147261 | A1 * | 7/2005 | Yeh | 381/92 |
| 2005/0195995 | A1 | 9/2005 | Baumgarte | |
| 2006/0198527 | A1 * | 9/2006 | Chun | 381/17 |
| 2007/0030982 | A1 | 2/2007 | Jones et al. | |
| 2007/0223740 | A1 * | 9/2007 | Reams | 381/119 |
| 2007/0291949 | A1 * | 12/2007 | Imaki | 381/17 |
| 2008/0033730 | A1 * | 2/2008 | Jot et al. | 704/500 |
| 2008/0205671 | A1 * | 8/2008 | Oh et al. | 381/119 |
| 2009/0043591 | A1 * | 2/2009 | Breebaart et al. | 704/500 |

(Continued)

FOREIGN PATENT DOCUMENTS

WO WO 2005/089360 9/2005

OTHER PUBLICATIONS

Author Unknown, "1999 IEEE Workshop on Applications of Signal Processing Audio and Acoustics," http://www.acoustics.hut.fi/waspaa99/program/accepted.html, Jul. 13, 1999.

(Continued)

*Primary Examiner* — Vivian Chin
*Assistant Examiner* — Friedrich W Fahnert
(74) *Attorney, Agent, or Firm* — Dorsey and Whitney LLP

(57) ABSTRACT

Methods are disclosed for improving sound localization of the human ear. In some embodiments, the method may include creating virtual movement of a plurality of localized sources by applying a periodic function to one or more location parameters of a head related transfer function (HRTF).

18 Claims, 12 Drawing Sheets

(56) References Cited

U.S. PATENT DOCUMENTS

| | | | | |
|---|---|---|---|---|
| 2009/0046864 | A1 | 2/2009 | Mahabub et al. | |
| 2009/0185693 | A1* | 7/2009 | Johnston et al. | 381/17 |
| 2009/0252356 | A1* | 10/2009 | Goodwin et al. | 381/310 |

OTHER PUBLICATIONS

Author Unknown, "Cape Arago Lighthouse Pt. Foghorns, Birds, Wind, and Waves," http://www.sonicstudios.com/foghorn.htm, 5 pages, at least as early as Oct. 28, 2004.

Author Unknown, "EveryMac.com," Apple Power Macintosh G5 2.0 DP(PCI-X) Specs (M9032LL/A), 6 pages, 2003.

Author Unknown, "General Solution of the Wave Equation," www.silcom.com/~aludwig/Physics/Gensol/General_solution.html, 10 pages, Dec. 2002.

Author Unknown, "The FIReverb Suite™ audio demonstration," http://www.catt.se/suite_music/, 5 pages, 2000-2001.

Author Unknown, "Vivid Curve Loon Lake CD Recording Session," http://www.sonicstudios.com/vcloonlk.htm, 10 pages, 1999.

Author Unknown, "Wave Field Synthesis: a brief overview," http://recherche.ircam.fr/equipes/salles/WFS_WEBSITE/Index_wfs_site.htm, 5 pages, at least as early as Oct. 28, 2004.

Author Unknown, "Wave Surround—Essential tools for sound processing," http://www.wavearts.com/WaveSurroundPro.html, 3 pages, 2004.

Gardner et al., "HRTF Measurements of a KEMAR Dummy-Head Microphone," MIT Media Lab-Technical Report #280, pp. 1-6, May 1994.

Glasgal, Ralph, "Ambiophonics—Ambiofiles : Now you can have 360° PanAmbio surround," http://www.ambiophonics.org/Ambiofiles.htm, 3 pages, at least as early as Oct. 28, 2004.

Glasgal, Ralph, "Ambiophonics—Testimonials," http://www.ambiophonics.org/testimonials.htm, 3 pages, at least as early as Oct. 28, 2004.

Li et al., "Recording and Rendering of Auditory Scenes through HRTF," University of Maryland, Perceptual Interfaces and Reality Lab and Neural Systems Lab, 1 page, at least as early as Oct. 28, 2004.

Miller III, Robert E., "Audio Engineering Society: Convention Paper," Presented at the 112th Conventsion, Munich, Germany, 12 pages, May 10-13, 2002.

Tronchin et al., "The Calculation of the Impulse Response in the Binaural Technique," Dienca-Ciarm, University of Bologna, Bologna, Italy, 8 pages, at least as early as Oct. 28, 2004.

Zotkin et al., "Rendering Localized Spatial Audio in a Virtual Auditory Space," Perceptual Interfaces and Reality Laboratory, Institute for Advanced Computer Studies, University of Maryland, College Park, Maryland, USA, 29 pages, 2002.

* cited by examiner $$y[n] = a_0 * x[n] + a_1 * x[n-1] + a_2 * x[n-2] - b_1 * y[n-1] - b_2 * y[n-2]$$

AUDIO SPATIALIZATION AND ENVIRONMENT SIMULATION

CROSS-REFERENCE TO RELATED APPLICATIONS

This application claims priority to U.S. provisional patent application No. 61/106,872, filed Oct. 20, 2008 and entitled "Audio Spatialization and Environment Simulation", the contents of which are incorporated herein by reference in their entirety.

This application is related to the following commonly owned patent applications, each of which are incorporated by reference as if set forth in full below:

U.S. Provisional Application No. 60/892,508, filed Mar. 1, 2007, entitled "Audio Spatialization and Environment Simulation";

U.S. utility application Ser. No. 12/041,191, filed Mar. 3, 2008, entitled "Audio Spatialization and Environment Simulation"; and PCT Application PCT/US08/55669, filed Mar. 3, 2008, entitled "Audio Spatialization and Environment Simulation".

SUMMARY

GenAudio's AstoundSound™ technology is a unique sound localization process that places a listener in the center of a virtual space of stationary and/or moving sound. Because of the psychoacoustic response of the human brain, the listener may perceive that these localized sounds emanate from arbitrary positions within space. The psychoacoustic effects from GenAudio's AstoundSound™ technology may be achieved through the application of digital signal processing (DSP) for head related transfer functions (HRTFs).

Generally speaking, HRTFs may model the shape and composition of a human being's head, shoulders, outer ear, torso, skin, and pinna. In some embodiments, two or more HRTFs (one for the left side of the head and one for the right side of the head) may modify an input sound signal so as to create the impression that sound emanates from a different (virtual) position in space. Using GenAudio's AstoundSound™ technology, a psychoacoustic effect may be realized from as few as two speakers.

In some embodiments this technology may be manifested through a software framework that implements the DSP HRTFs through a binaural filtering method such as splitting the audio signal into a left-ear and right-ear channel and applying a separate set of digital filters to each of the two channels. Furthermore, in some embodiments, the post filtering of localized audio output may be accomplished without using encoding/decoding or special playback equipment.

The AstoundSound™ technology may be realized through Model-View-Controller (MVC) software architecture. This type of architecture may enable the technology to be instantiated in many different forms. In some embodiments, applications of AstoundSound™ may have access to similar underlying processing code, via a set of common software interfaces. Further, the AstoundSound™ technology core may include Controllers and Models that may be used across multiple platforms (e.g., may operate on Macintosh, Windows and/or Linux). These Controllers and Models also may enable real-time DSP processing play-through of audio input signals.

BRIEF DESCRIPTION OF THE DRAWINGS

FIG. 5 illustrates a process flow for a plug-in.

FIG. 6 illustrates a potential wiring diagram for the plug-in.

FIG. 8 illustrates a process flow for a plug-in.

DESCRIPTION

AstoundStereo™ Expander Application

In some embodiments, the AstoundStereo™ Expander application may be implemented as a stand-alone executable that may take as input normal stereo audio and process it such that the output has a significantly wider stereo image. Further, the center information from the input (e.g., vocals and/or center staged instruments) may be preserved. Thus, the listener may "hear" a wider stereo image because the underlying AstoundStereo™ DSP technology creates the psychoacoustic perception that virtual speakers emanating the audio have been placed at a predetermined angle of azimuth, elevation and distance relative to the listener's head. This virtual localization of the audio may appear to place the virtual speakers farther apart than the listener's physical speakers and/or headphones.

One embodiment of the Expander may be instantiated as an audio device driver for computers. As a result, the Expander application may be a globally executed audio processor capable of processing a substantial amount of the audio generated by and/or passing through the computer. For example, in some embodiments, the Expander application may process all 3rd party applications producing or routing audio on the computer.

Another consequence of the Expander being instantiated as an audio device driver for computers is that the Expander may be present and active while a user is logged into his/her computer account. Thus, a substantial amount of audio may be routed to the Expander and processed in real-time without loading individual files for processing, which may be the case for 3rd party applications such as iTunes and/or DVD Player.

Some of the features of the AstoundStereo™ Expander include:

Stereo Expanded Symmetric Virtual Speaker Localization (EL, AZ, DIST)

Stereo Expansion Intensity Adjustment

ActiveBass™

Global Bypass

Selectable Output Devices

Process Flow

Figure 1:
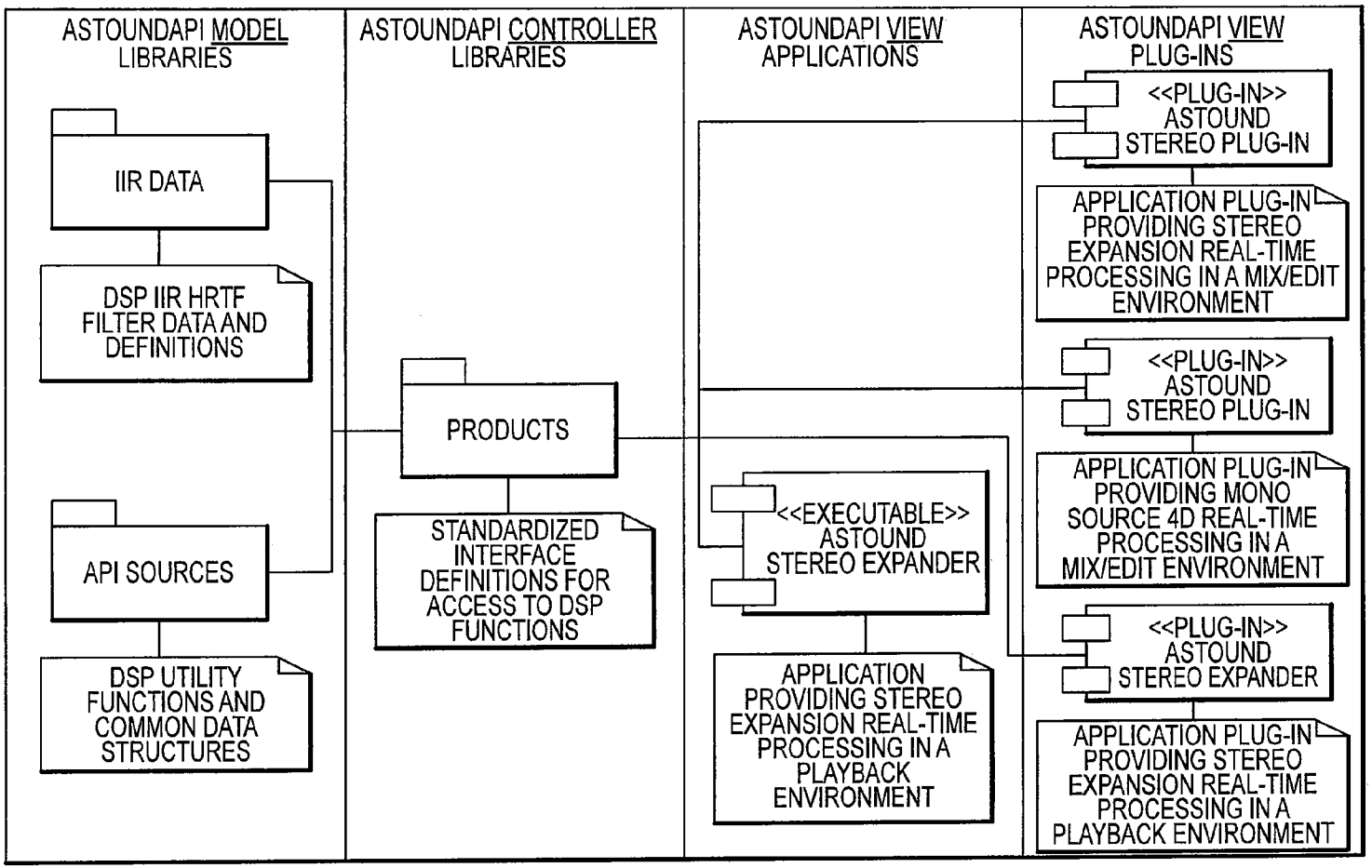
FIG. 1 illustrates a model view controller for a potential system architecture.
Figure 2:
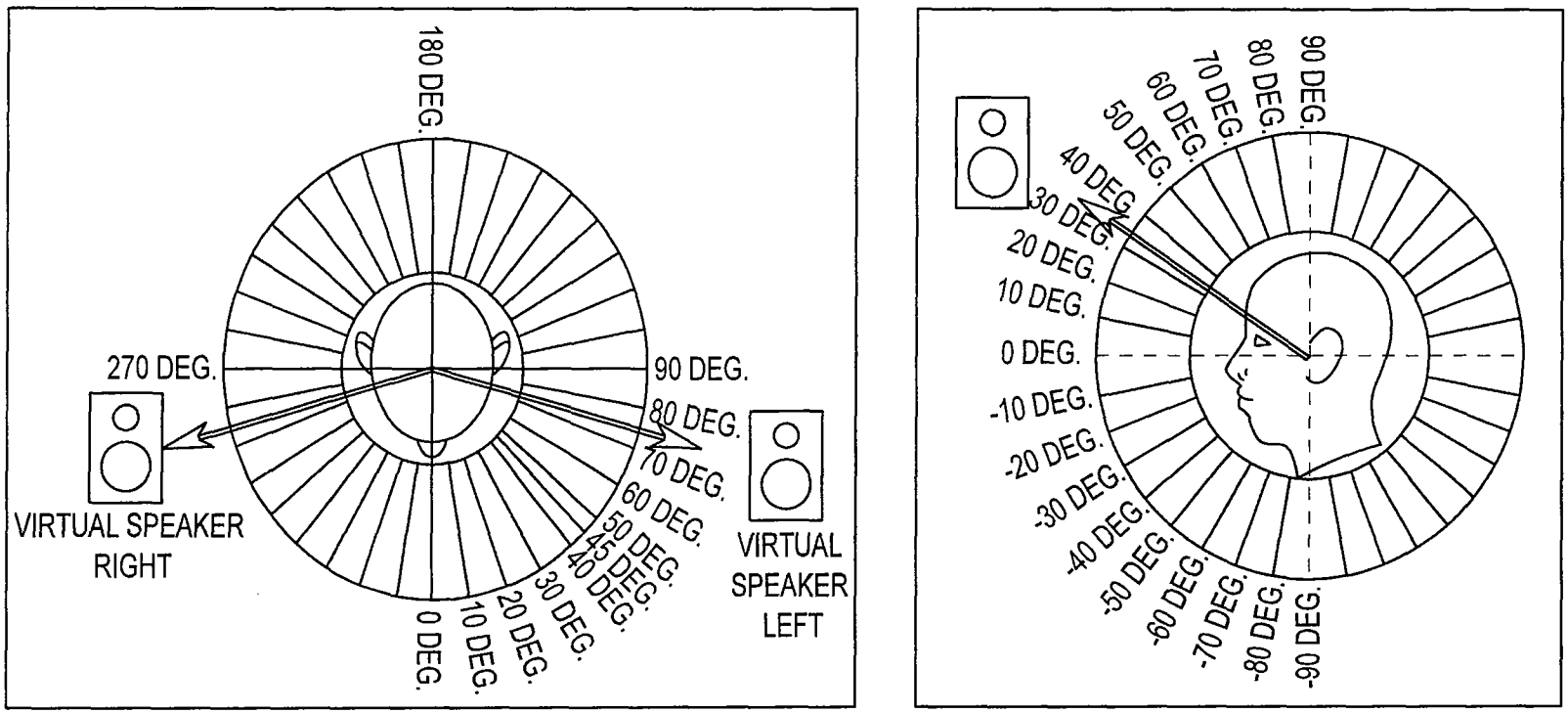
FIG. 2 illustrates one or more virtual speakers in azimuth and elevation relative to a listener.
Figure 3:
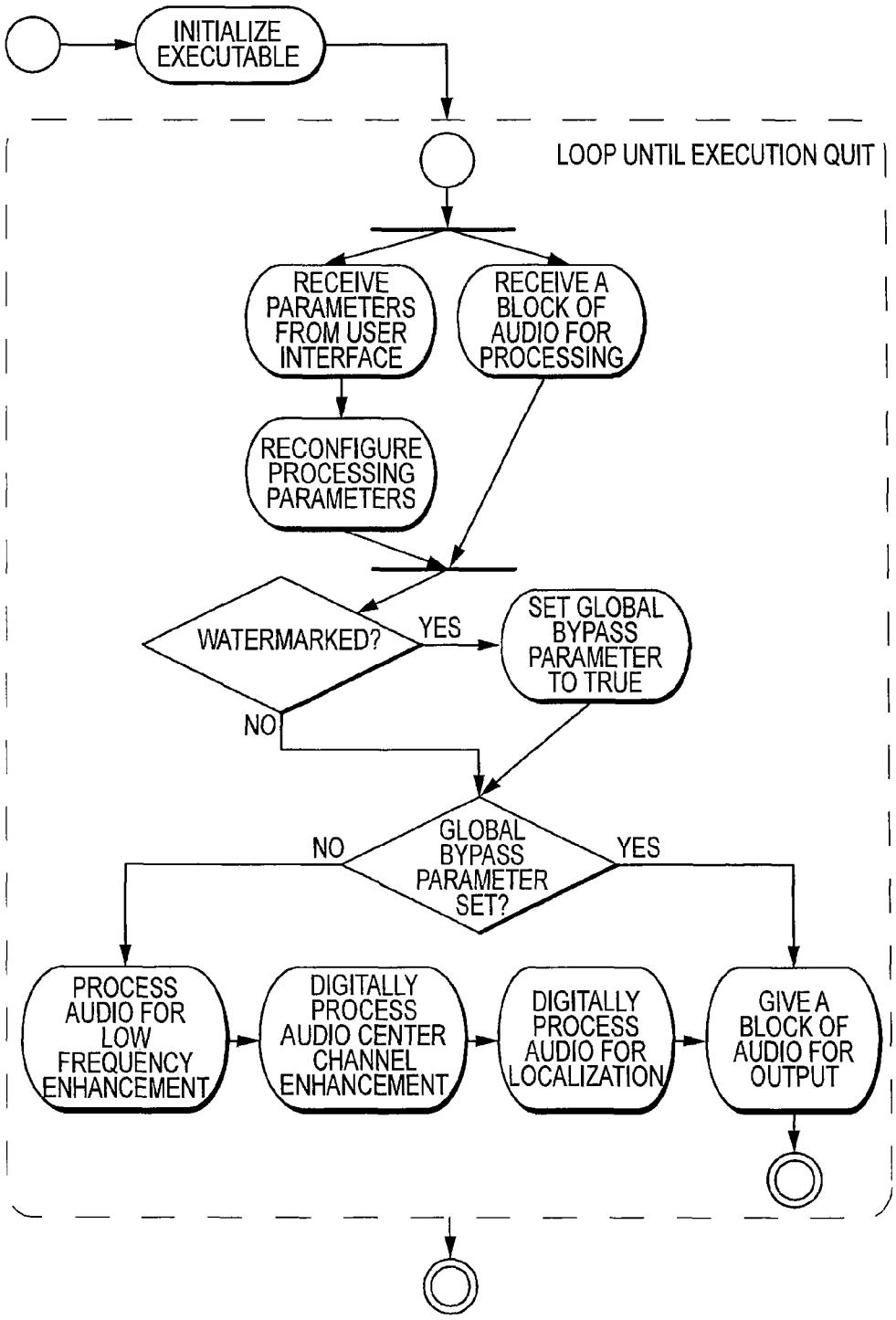
FIG. 3 illustrates a process flow for an expander.
Figure 11:
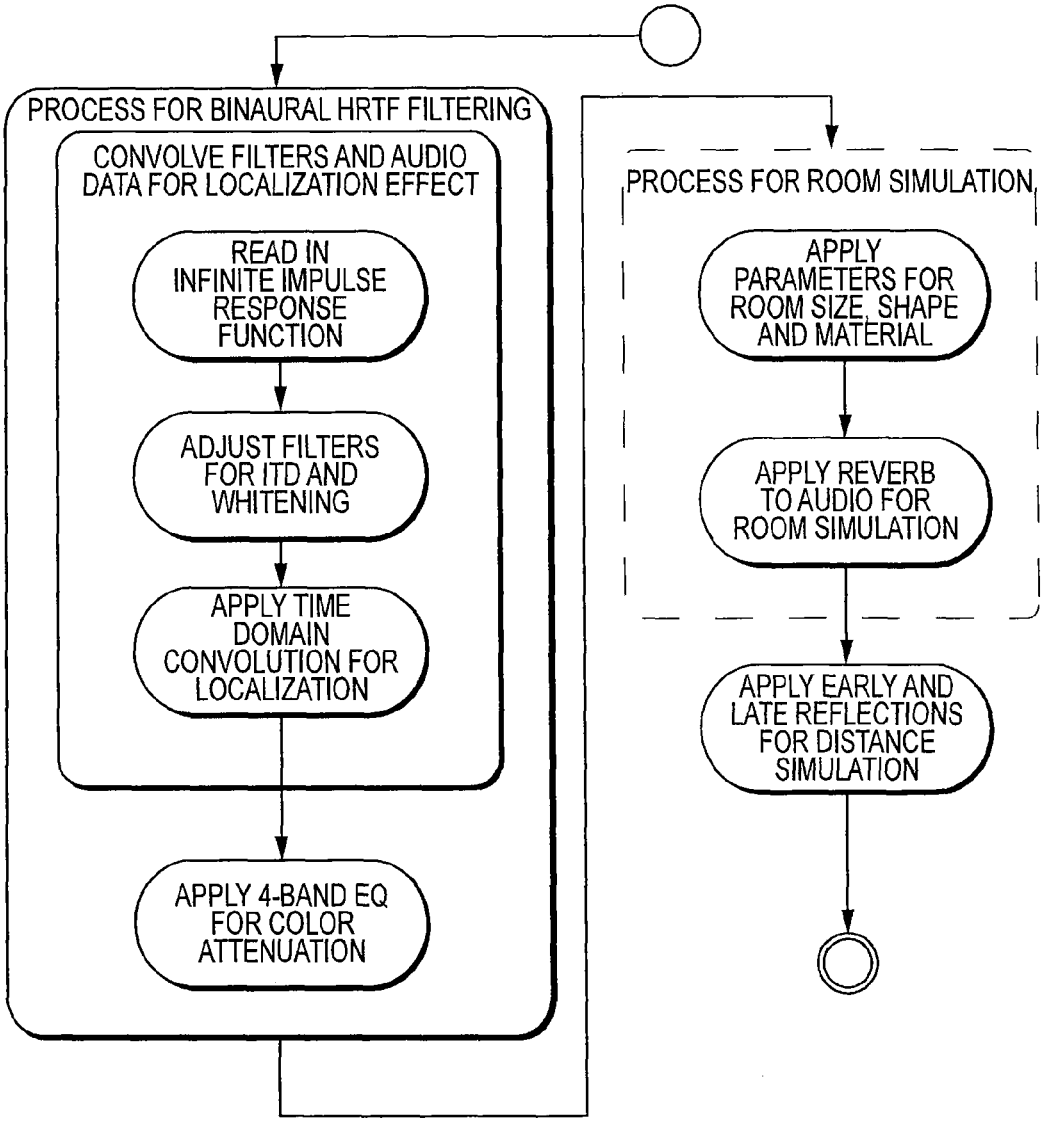
FIG. 11 illustrates a process flow for audio localization.

A software controller class, from the Products Controller library, may enable the process flow of the AstoundStereo™ Expander application. As mentioned previously, the controller class may be a common interface definition to the underlying DSP models and functionality. The controller class may define the DSP interactions that are appropriate for stereo expansion processing. FIG. 3 illustrates an exemplary DSP interaction titled "Digitally process audio for localization", which may be appropriate for stereo expansion. The activity shown in FIG. 3 is depicted in greater detail in FIG. 11.

Figure 4:
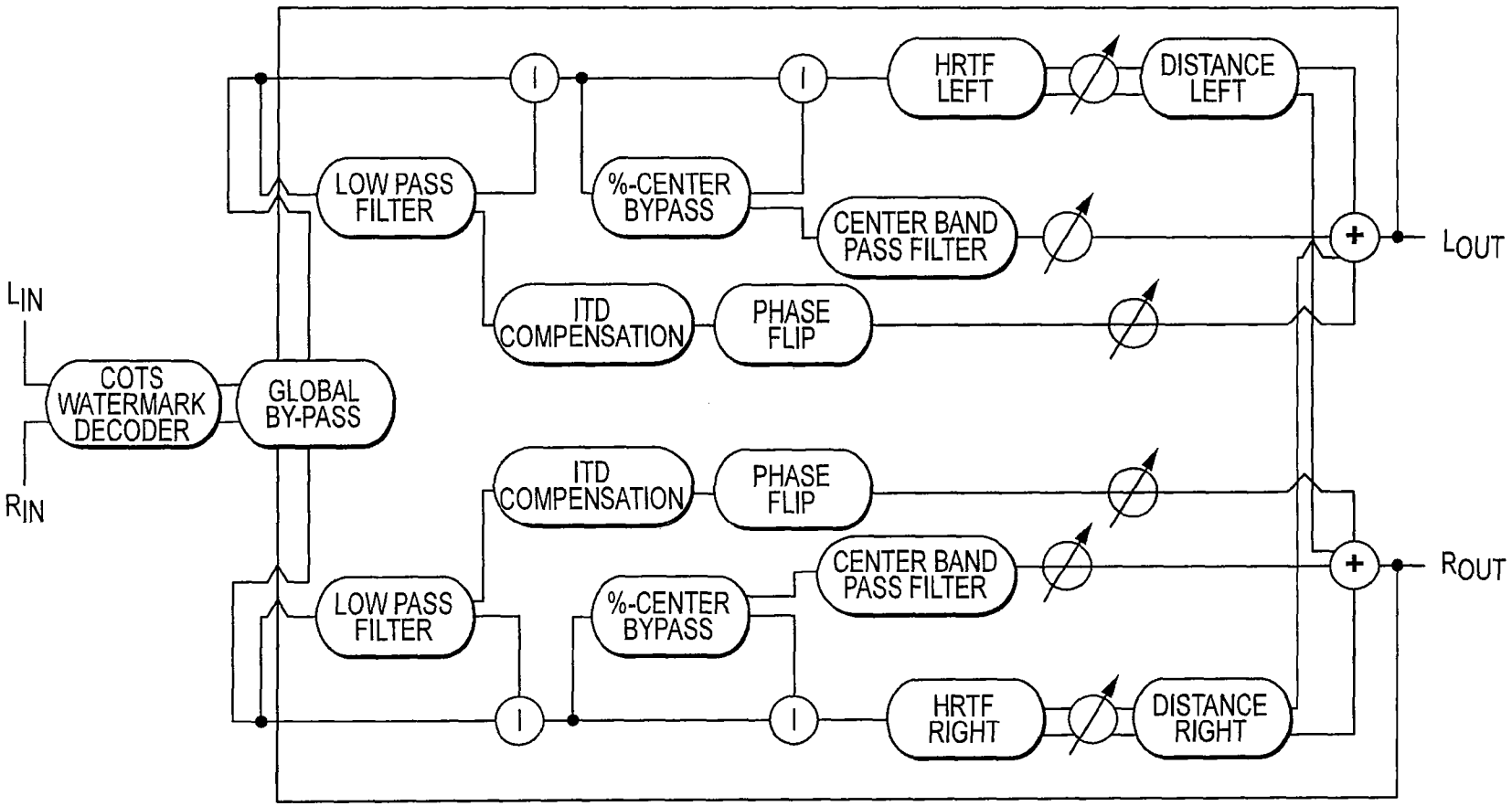
FIG. 4 illustrates a potential wiring diagram for the expander.
Figure 5:
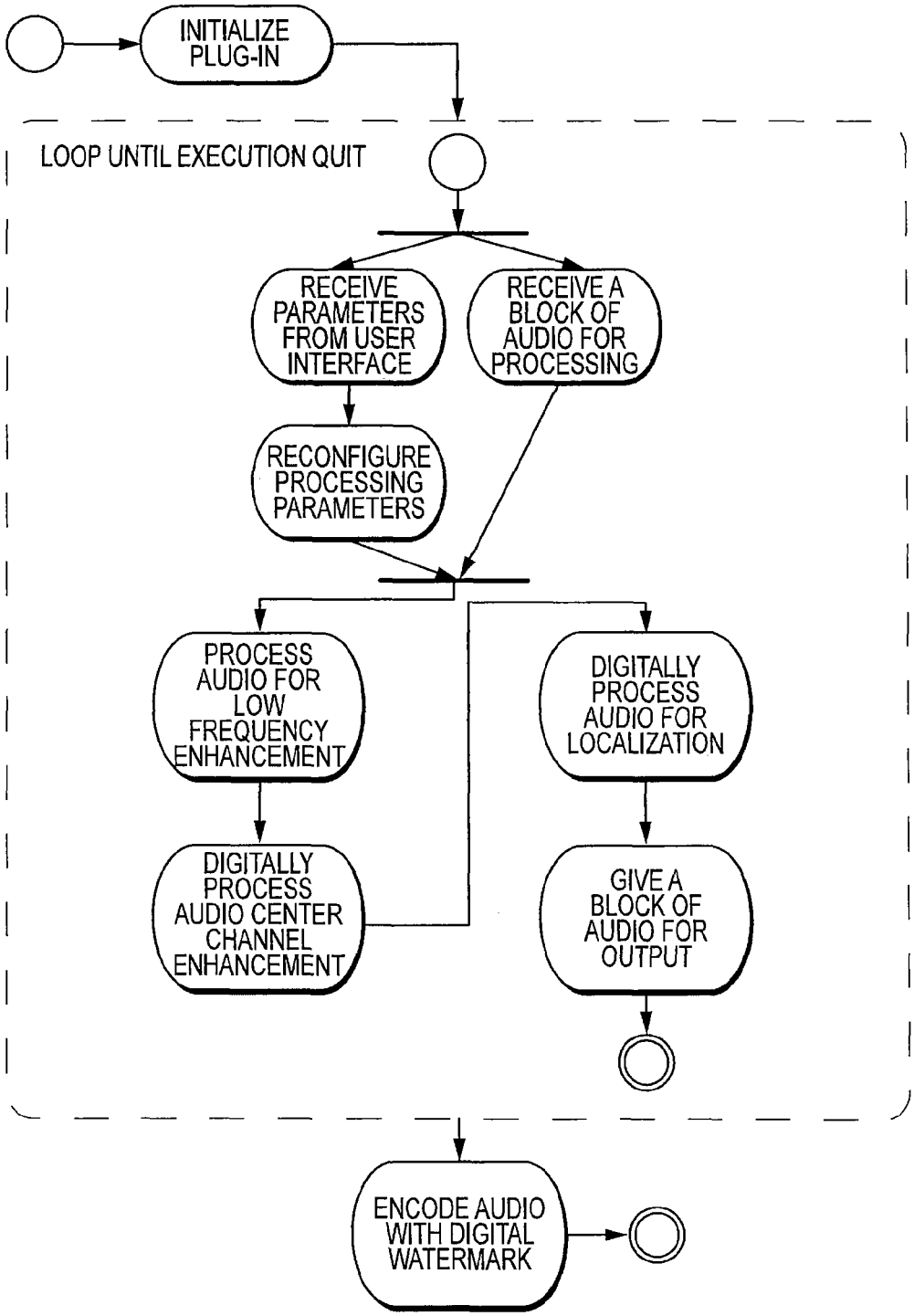

The controller may accept a two-channel stereo signal as input, where the signal may be separated into a left and right channel. Each channel then may be routed through the set of AstoundStereo linear DSP functions, as shown in FIG. 4, and localized to a particular point in space (e.g., the two virtual speaker positions).

The virtual speaker locations may be fixed by the view-based application to be at a particular azimuth, elevation and distance, relative to the listener (e.g., see Infinite Impulse Response Filters below), where one virtual speaker is located some distance away from the listener's left ear and the other some distance away from the listener's right ear. These positions may be combined with parameters for %-Center Bypass (described in greater detail below) for enhanced vocals and center stage instrument presence, parameters for low pass filtering and compensation (e.g., see Low Frequency Processing below) for enhanced low frequency response, and parameters for distance simulation (see e.g., distance simulation description in PCT Application PCT/US08/55669, filed Mar. 3, 2008, entitled "Audio Spatialization and Environment Simulation").

Combining the positions with these parameters may give the listener the perception of a wider stereo field.

Notably, the virtual speaker locations may be non-symmetrical in some embodiments. Symmetric positioning may undesirably diminish the localization effect (e.g., due to signal cancellation), which is described in greater detail below with regard to Hemispherical Symmetry.

Because the AstoundStereo Expander is an application (rather than a plug-in), it may contain a global DSP bypass switch to circumvent the DSP processing and allow the listener to hear the audio signal in its original stereo form. Additionally, the Expander may include an integrated digital watermarking technology that may detect a unique and inaudible GenAudio digital watermark. Detection of this watermark may automatically cause the AstoundStereo Expander process to enable global bypass. A watermarked signal may indicate that the input signal has been altered to already contain AstoundSound™ functionality. Bypassing this type of signal may be done to avoid processing the input signal twice and diminishing or otherwise corrupting the localization effect.

In some embodiments, the AstoundStereo™ process may include a user definable stereo expansion intensity level. This adjustable parameter may combine all the parameters for low frequency processing, %-center bypass and localization gain. Furthermore, some embodiments may include predetermined minimum and maximum settings for the stereo expansion intensity level. This user definable adjustment may be a linear interpolation between the minimum and maximum values for all associated parameters.

The ActiveBass™ feature of the AstoundStereo™ technology may include a user selectable switch that may increase one or more of the low frequency parameters (described below in the Low Frequency Processing section) to a predetermined setting for a deeper, richer, and more present bass response from the listener's audio output device.

In some embodiments, the selectable output device feature may be a mechanism by which the listener can choose from among various output devices, such as, built-in computer speakers, headphones, external speakers via the computer's line-out port, a USB/FireWire speaker/output device and/or any other installed port that can route audio to a speaker/output device.

AstoundStereo™ Expander Plug-in Application

Some embodiments may include an AstoundStereo™ Expander Plug-in that may be substantially similar the AstoundStereo™ Expander Executable. In some embodiments, the Expander Plug-in may differ from the Expander Executable in that it may be hosted by a 3rd party executable. For example, the Expander Plug-in may reside within an audio playback executable such as Windows Media Player, iTunes, Real Player and/or WinAmp to name but a few. Notably, the Expander Plug-in may include substantially the same features and functionality as the Expander Executable.

Process Flow

While the Expander Plug-in may include substantially the same internal process flows as the Expander executable, the external flow may differ. For example, instead of the user or the system instantiating the Plug-in, this may be handled by the 3rd party audio playback executable.

AstoundStereo™ Plug-in Application

The AstoundStereo™ Plug-in may be hosted by a 3rd party executable (e.g. ProTools, Logic, Nuendo, Audacity, Garage Band, etc.) yet it may have some similarities to the AstoundStereo™ Expander. Similar to the Expander, it may create a wide stereo field, however, unlike the Expander it may be tailored for the professional sound engineer and may expose numerous DSP parameters and allow a wide range of tunable control of the parameters to be accessed via a 3D user interface. Also, unlike the Expander, some embodiments of the Plug-in may differ from the Expander by integrating a digital watermarking component that may encode a digital watermark into the final output audio signal. Watermarking in this fashion may enable GenAudio to uniquely identify a wide variety of audio processed with this technology. In some embodiments, the exposed parameters may include:

Localization Azimuth & Elevation

Independent Left & Right Localization Gain

Localization Distance & Distance Reverberation

Positional Vibrato in Azimuth & Elevation for increased perception of the localized audio output Master Input & Output Gain Center Bypass Spread & Gain Center Band Pass Frequency & Bandwidth Low Frequency Band Pass Frequency, Roll-off, Gain & ITD Compensation 4-Band HRTF Filter Equalization Reflection Localization Azimuth & Elevation (discussed in further detail below in the Reverb Localization section)

Reflection Localization Amount, Room Size, Decay, Density & Damping

Process Flow

The Plug-in may be instantiated and destroyed by the 3rd party host executable.

%-Center Bypass

The %-center bypass (referred to above in FIGS. 3 and 6) is a DSP element that allows, in some embodiments, at least a portion of the audio's center information (e.g. vocals or "center stage" instruments) to be left unprocessed. The amount of center information in a stereo audio input that may be allowed to bypass processing may vary between different embodiments.

By allowing certain stereo audio to be bypassed, center channel information may remain prominent, which is a more natural, true-to-life representation. Without this feature, center information may become lost or diminished and give an unnatural sound to the audio. During operation, before the actual localization processing takes place, the incoming audio signal may be split into a center signal and a stereo edge signal. In some embodiments, this process may include subtracting out the L+R mono sum from the left and right channels—i.e., M-S decoding. The center portion may be subsequently processed after the stereo edges have been processed.

In this manner, Center Bypass may determine how much of the processed center signal is added back to the output.

Center Band Pass

Figure 6:
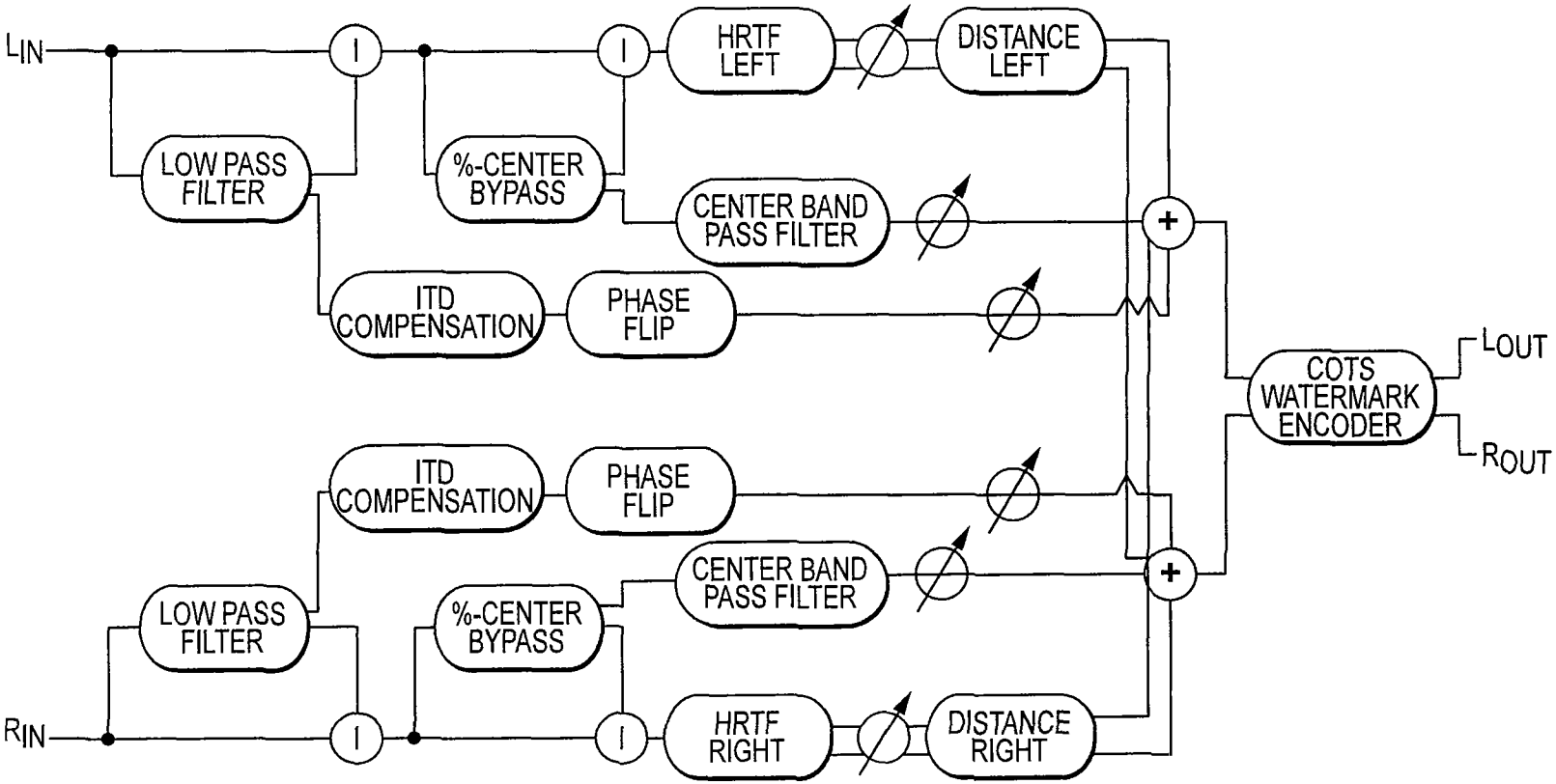
Figure 7:
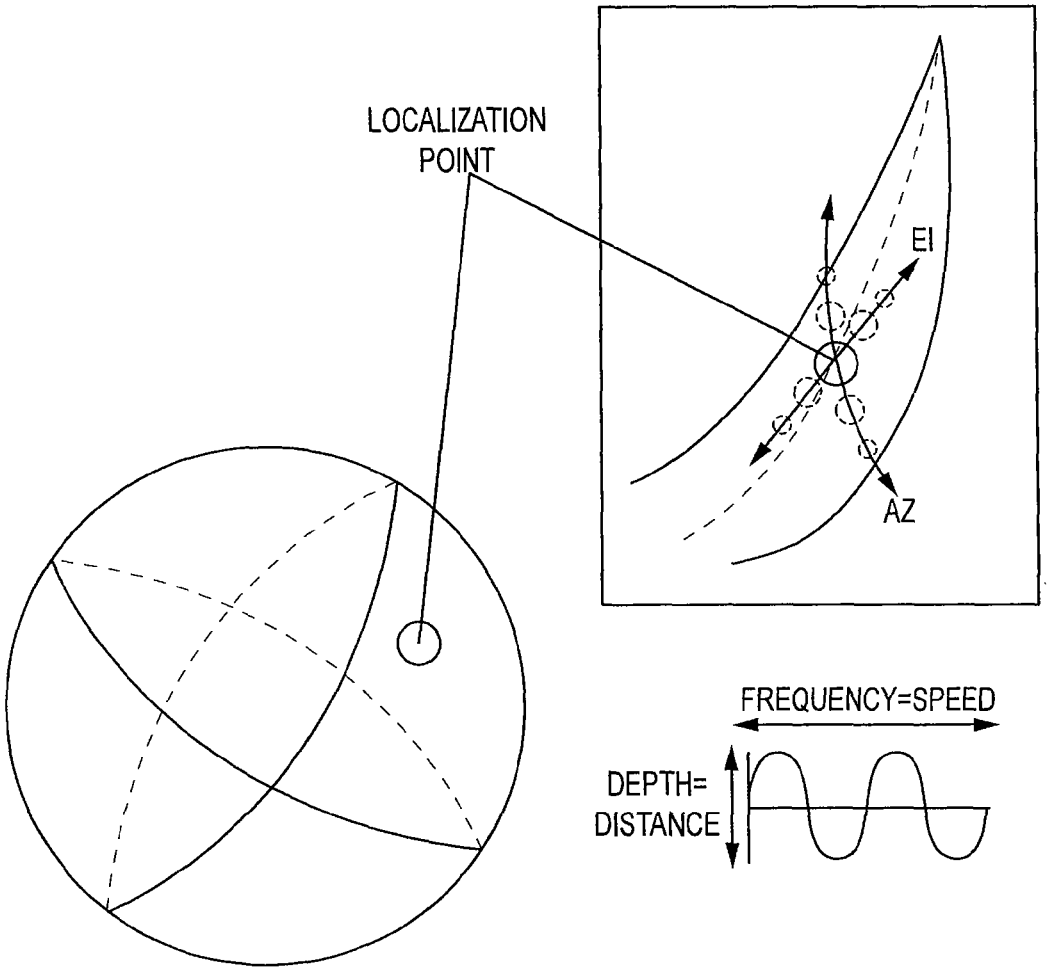
FIG. 7 illustrates oscillating a virtual sound source in three dimensional space.
Figure 8:
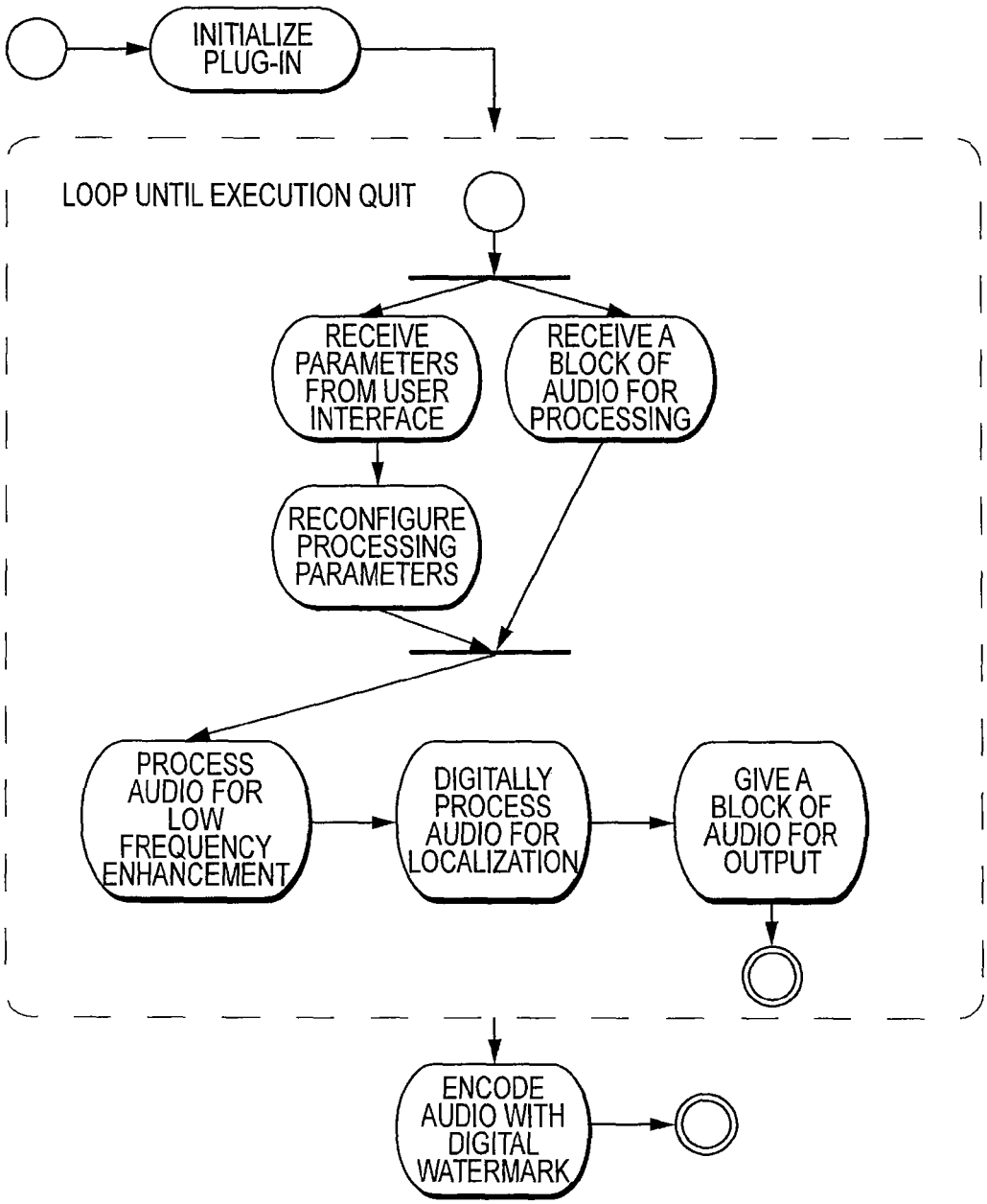
Figure 9:
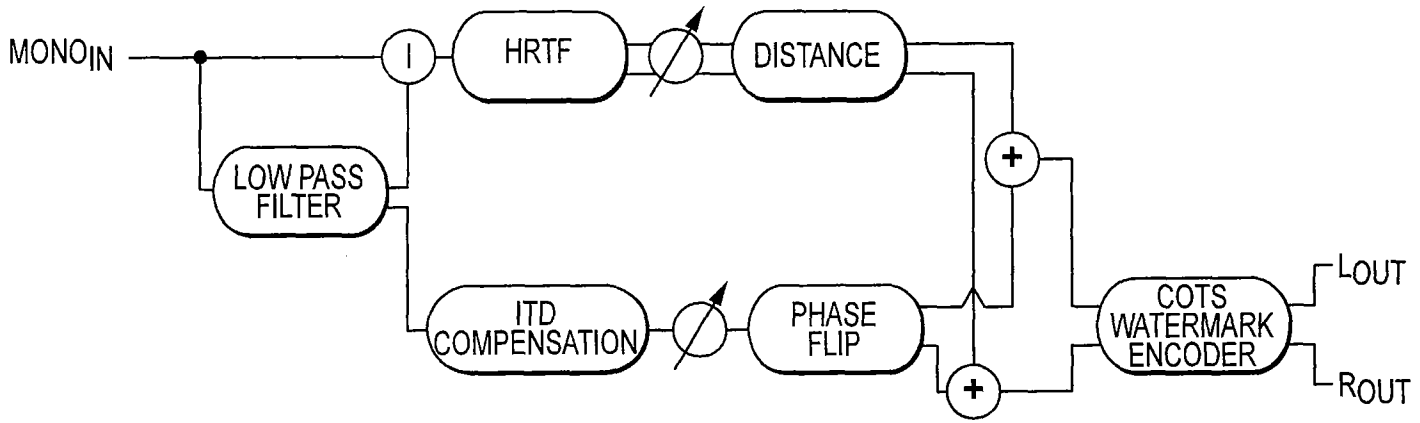
FIG. 9 illustrates a potential wiring diagram.
Figure 10:
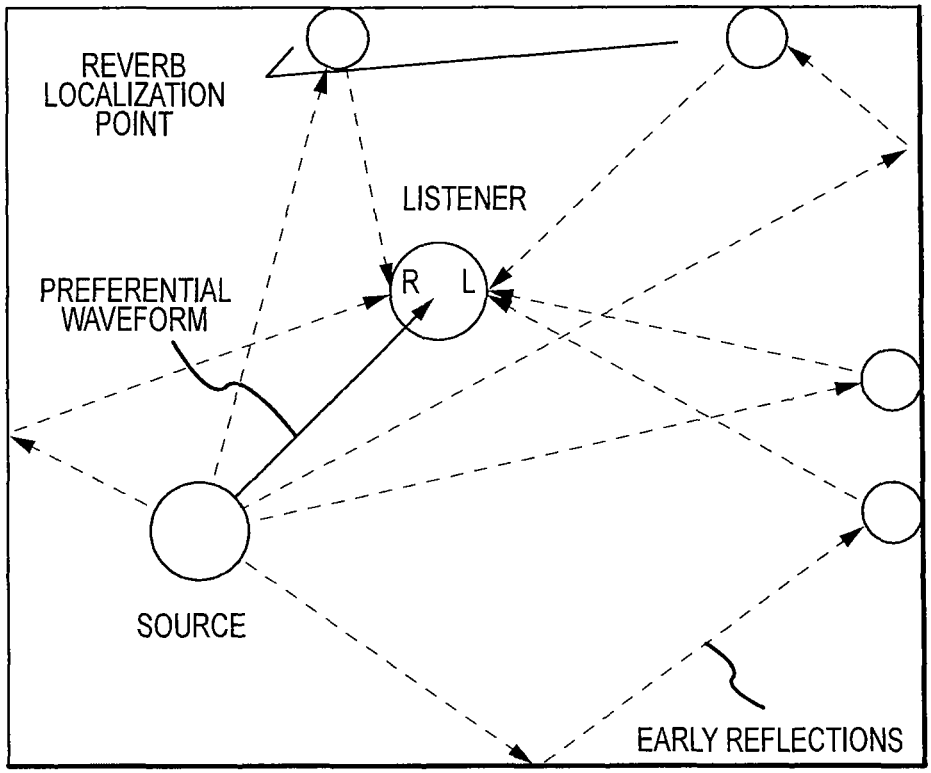
FIG. 10 illustrates localization of source audio reflections.

The center band pass DSP element shown in FIG. 6 may enhance the results of the %-center bypass DSP element. The center signal may be processed with a variable band pass filter in order to emphasize the lead vocal or instrument (which are commonly present in the center channel of a recording). If only the entire center channel is attenuated, the vocals and lead instruments may be removed from the mix, creating a "Karaoke" effect, which is not desired for some applications. Applying a band pass filter may alleviate this problem by selectively removing frequencies that are less relevant for the lead vocal, and therefore, may widen the stereo image without losing the lead vocals.

Spatial Oscillator

The human brain may more accurately determine the location of a sound if there is relative movement between the sound source and human ear. For example, a listener may move their head from side to side to help determine a sound location when the sound source is stationary. The reverse is also true. Thus, the spatial oscillator DSP element may take a given localized sound source and vibrate and/or shake it in a localized space to provide additional spatialization to the listener. In other words, by vibrating and/or shaking both virtual speakers (localized sound sources) the listener can more easily detect the spatialization effect of the AstoundStereo™ process.

In some embodiments, the overall movement of the virtual speaker(s) may be very small, or nearly imperceptible. Even though the movement of the virtual speakers may be small, however, it may be enough for the brain to recognize and determine location. The spatial oscillation of a localized sound may be accomplished by applying a periodic function to the location parameters of the HRTF function. Such periodic functions may include, but are not limited to sinusoidal, square wave, and/or triangular to name but a few. Some embodiments may use a sine wave generator in conjunction with a frequency and depth variable to repeatedly adjust the azimuth of the localization point. In this manner, frequency is a multiplier that may indicate the speed of vibration, and depth is a multiplier that may indicate the absolute value of the distance traveled for the localization point. The update rate for this process may be on a per sample basis in some embodiments.

Hemispherical Symmetry

Since the listener's head is symmetric with regard to the sagittal plane of the body, this symmetry may be exploited to reduce the amount of stored filter coefficients by ½ in some embodiments. Instead of storing filter coefficients for a given symmetric position to the left and right of the listener (such as at 90° and 270° azimuth) filter coefficients may be selectively stored for one side, and then reproduced for the reciprocal side by swapping both the position and the output channels. In other words, instead of processing the position at 270° azimuth, the filter corresponding to 90° azimuth may be used and then the left and right channels may be swapped to mirror the effect to the other side of the hemisphere.

AstoundSound™ Plug-in Application

The AstoundSound™ Plug-in for the professional sound engineer may have similarities to the AstoundStereo™ Plug-in. For example, it may be hosted by a 3rd party executable and also may expose all DSP parameters for a wide range of tuning capability. The two may differ in that the AstoundSound Plug-in may take a mono signal as input and allow a full 4D (3-dimensional spatial localization with movement over time) control of a single sound source, via a 3D user interface. Unlike the other applications discussed in this document, the AstoundSound Plug-in may enable the use of a 3D input device for moving the virtual sound sources in 3D space (e.g., a "3D mouse").

Furthermore, the AstoundSound Plug-in may integrate a watermarking component that encodes a digital watermark directly into the final output audio signal, enabling GenAudio to uniquely identify a wide variety of audio processed with this technology. Because some embodiments may implement this functionality as a plug-in, the host executable may instantiate multiple instances of the plug-in, which may allow multiple mono sound sources to be spatialized. In some embodiments, a consolidated user interface may show one or more localized positions of these independent instantiations of the AstoundSound Plug-in running within the host. In some embodiments, the exposed parameters may include:

Localization Azimuth & Elevation

Localization Distance & Distance Reverberation

Positional Vibrato in Azimuth & Elevation

Master Input & Output Gain

Low Frequency Band Pass Frequency, Roll-off, Gain & ITD Compensation

4-Band HRTF Filter Equalization

Reflection Localization Azimuth & Elevation (see section Reverb Localization for details)

Reflection Localization Amount, Room Size, Decay, Density & Damping

Process Flow

The plug-in this is instantiated and destroyed by the 3rd party hosting executable.

Reverb Localization

In order to improve the spatialization effect, some embodiments may localize the reverberated (or reflected) signals by applying a different set of localization filters than the direct ("dry") signal. We can therefore position the perceived origin of the direct signal's reflections out of the way of the direct signal itself. While the reflections can be localized anywhere (i.e. variable positioning), it has been determined that positioning them to the back of the listener results in higher clarity and better overall spatialization.

Common Technologies

Infinite Impulse Response Filters

Conventional AstoundSound™ DSP technology may define numerous (e.g., ~7,000+) independent points on a notional unit sphere. For each of these points, two finite impulse response (FIR) filters were calculated, based on the right and left HRTFs for that point and the inverses of the right and left head-to-ear-canal transfer functions.

In some embodiments, the FIR filters may be supplanted by a set of Infinite Impulse Response (IIR) filters. For example, a set of 64-coefficient IIR filters may be created from the original 1,920-coefficient FIR HRTF filters using a least mean square error approximation. Unlike the block based processing necessary to do linear convolution in the frequency domain, IIR filters may be convolved in the time domain without needing to perform a Fourier transform. This time domain convolution process may be used to calculate the localized result on a sample-by-sample basis. In some embodiments, the IIR filters do not have an inherent latency, and therefore, they may be used for simulating both position updates and localizing sound waves without introducing a perceivable processing delay (latency). Furthermore, the reduction in the number of coefficients from 1,920 in the original FIR filters to 64 coefficients in the IIR filters may reduce significantly the memory footprint and/or CPU cycles used to calculate the localized result. An Inter-aural Time Difference (ITD) may be added back into the signal by delaying the left and right signal according to the ITD measurements derived from the original FIR filters.

Because the HRTF measurements may be performed at regular intervals in space with a relatively fine resolution, spatial interpolation between neighboring filters may be minimized for position updates (i.e. when moving a sound source over time). In fact, some embodiments may accomplish this without any interpolation. That is, moving sound source directions may be simulated by loading the IIR filters for the nearest measured direction. Position updates then may be smoothed across a small number of samples to avoid any zipper noise when switching between neighboring IIR filters. A linearly interpolated delay line may be applied for ITD to both right and left channels allowing for sub-sample accuracy.

Figure 12:
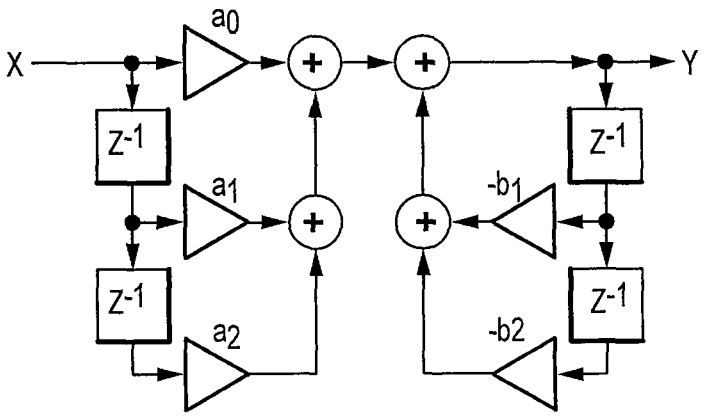
FIG. 12 illustrates a biquad filter and equation.

IIR filters are similar to FIR filters in that they also process samples by calculating a weighted sum of the past (and/or future) samples, where the weights may be determined by a set of coefficients. However, in the IIR situation, this output may be fed back to the filter input thereby creating an asymptotically decaying impulse response that theoretically never decays to zero—hence the name "Infinite Impulse Response". Feeding back the processed signal in this manner may "reprocess" the signal partially by running it through the filter multiple times, and therefore, increase the control or steepness of the filter for a given number of coefficients. A general diagram for an IIR biquad structure as well as the formula for generating its output is shown below in FIG. 12:

Sample Rate Independence

Conventional FIR filters were sampled at a 44.1 kHz sample rate, and therefore due to Nyquist criterion, the FIR filters were capable of processing signals between 0 Hz and half the sampling rate (i.e., the Nyquist frequency). However, in today's audio production environments, higher sampling rates may be desired. In order to enable the AstoundSound™ filters to deal with higher sample rates without losing the high frequency content that comes with the higher sample rates, the frequencies above the Nyquist frequency of the original filters (22,050 Hz) may be bypassed. To accomplish this bypassing, the signal may be first split into low (<Nyquist) and high (>=Nyquist) frequency bands. The low frequency band then may be down-sampled to the sampling frequency of the conventional HRTF filters and subsequently processed by the localization algorithm at a 44.1 kHz sampling frequency. Meanwhile, the high frequency band may be retained for later processing. After the localization processing has been applied to the low frequency band, the resulting localized signal may be again up-sampled to the conventional sample rate and mixed with the high frequency band. In this manner, a bypass for the high frequencies may be created in the original signal that would not have survived sample rate conversion to 44.1 kHz.

Alternate embodiments may achieve the same effect by extending the sampling rate of the conventional FIR filters by re-designing them at a higher sample rate and/or converting them to an IIR structure. However, this may imply two additional sample rate conversions that to be applied to the processed signal, and therefore, may represent a higher processing load when processing the more frequently encountered sample rates like 44.1 kHz. Because the 44.1 kHz sample rate has been well tested and is still a frequently encountered sample rate on today's consumer music reproduction systems, some embodiments may eliminate the extra bandwidth and only apply sample rate conversion in a more limited number of cases. Also, since a substantial portion of the AstoundSound™ DSP processing may be carried out at 44.1 kHz, fewer CPU instructions may be consumed per sample cycle.

Filter Equalization

"Filter equalization" generally refers to the process of attenuating certain frequency spectrum bands to reduce colorization that can be introduced in HRTF localization. Conventionally, for the numerous (e.g., ~7,000+) independent filter points, an average magnitude response was calculated to determine the overall deviation of the filters from an idealized (flat) magnitude response process. This averaging process identified 4 distinct peaks in the frequency spectrum of the conventional filter set that deviated from a flat magnitude causing the filters to colorize the signal in potentially undesired ways. In order to define a localization/colorization tradeoff, some embodiments of the AstoundSound™ DSP implementation may add a 4-band equalizer at the 4 distinct frequencies, thereby attenuating the gain at these distinct points in frequency. Although 4 distinct frequencies have been discussed herein, it should be noted that any number of distinctive frequency equalization points are possible and a multi-band equalizer may be implemented, where each distinct frequency may be addressed by one or more bands of the equalizer.

Low Frequency Processing

Low Pass Filtering

In some embodiments, low frequencies may not need to be localized. Additionally, in some cases, localizing low frequencies may alter their presence and impact the final output audio. Thus, in some embodiments, the low frequencies present in the input signal may be bypassed. For example, the signal may be split in frequency allowing the low frequencies to pass through unaltered. It should be noted that the precise frequency threshold at which bypass begins (referred to herein as the "LP Frequency") and/or the localization of the onset of the bypass in frequency (referred to herein as the "Q factor" or "rolloff") may be variable.

ITD Compensation

When preparing the final mixing of the localized signal with the bypassed low frequency signal, prior to final output, the time delay introduced into the localized signal by the inter-aural time difference (ITD) may cause both signals to have different relative time delays. This time delay artifact may create a misalignment in phase for the low frequency content at the transition frequency when it is mixed with the localized signal. Thus, in some embodiments, delaying the low frequency signal by a predetermined amount using an ITD compensation parameter may compensate for the phase misalignment.

Phase Flip

In some cases, the phase misalignment between the localized signal and the bypassed low frequency signal may cause the low frequency signal to be attenuated to a point where it is almost cancelled out. Thus, in some embodiments, the phase of the signal may be flipped by reversing the polarity of the signal (which is equivalent to multiplying the signal by −1). Flipping the signal in this manner may change the attenuation into a boost, bringing back much of the original low frequency signal.

Low Pass Gain

In some embodiments, the low frequencies may have an adjustable output gain. This adjustment may allow for filtered low frequencies to have a more or less prominent presence in the final audio output.

The invention claimed is:

1. A method for improving sound localization of the human ear, the method comprising:

receiving a stereo signal having a plurality of channels;

applying at least a first head related transfer function (HRTF) to a first channel of the plurality of channels of the stereo signal to localize the first channel to a first particular point in space;

creating virtual movement of the first channel by applying a periodic function to at least one location parameter of the at least the first HRTF;

applying at least a second HRTF to a second channel of the plurality of channels of the stereo signal to localize the second channel to a second particular point in space; and transmitting the stereo signal with the localized first channel and the localized second channel to an output.

2. The method of claim 1, wherein the first particular point in space is positioned at a first angle of azimuth, a first elevation, and a first distance relative to an assumed position of a listener's head and the second particular point in space is positioned at a second angle of azimuth, a second elevation, and a second distance relative to the assumed position of the listener's head.

3. The method of claim 2, wherein the first particular point in space and the second particular point in space are non-symmetrically positioned with respect to the assumed position of listener's head.

4. The method of claim 2, wherein the first particular point in space is separately positioned from a first physical speaker for playing at least the first channel and the second particular point in space is separately positioned from a second physical speaker for playing at least the second channel.

5. The method of claim 4, wherein a virtual speaker distance between the first particular point in space and the second particular point in space is greater than a physical speaker distance between the first physical speaker and the second physical speaker.

6. The method of claim 1, wherein the periodic function comprises at least one of a sinusoidal periodic function, a square wave periodic function, and a triangular periodic function.

7. The method of claim 1, wherein applying the periodic function comprises utilizing a sine wave generator in conjunction with a frequency and depth variable to repeatedly adjust an angle of azimuth of the first particular point in space relative to an assumed position of a listener's head.

8. The method of claim 1, wherein the at least the first HRTF is not applied to at least a portion of center information of the first channel of the plurality of channels.

9. The method of claim 8, wherein the at least a portion of center information is derived by splitting the first channel of the plurality of channels into at least a center signal and a stereo edge signal, the at least a portion of center information corresponding to the center signal.

10. The method of claim 9, wherein splitting the first channel of the plurality of channels into the at least the center signal and the stereo edge signal further comprises subtracting a mono sum of the first channel of the plurality of channels and the second channel of the plurality of channels from the first channel to obtain the center signal.

11. The method of claim 1, further comprising:

applying at least a third HRTF to a reverberation of the first channel of the plurality of channels to localize the reverberation of the first channel to a third particular point in space.

12. The method of claim 11, wherein the third particular point in space is located behind an assumed position of a listener's head.

13. The method of claim 1, wherein said applying at least a first head related transfer function (HRTF) to a first channel of the plurality of channels further comprises:

splitting the first channel of the plurality of channels into at least a low frequency portion and a high frequency portion;

downsampling the low frequency portion;

applying the at least the first HRTF to the downsampled low frequency portion to localize the downsampled low frequency portion;

upsampling the localized low frequency portion; and combining the upsampled low frequency portion with the high frequency portion.

14. The method of claim 1, wherein said applying at least a first head related transfer function (HRTF) to a first channel of the plurality of channels further comprises:

splitting the first channel of the plurality of channels into at least a low frequency portion and a high frequency portion;

applying the at least the first HRTF to the high frequency portion, but not the low frequency portion, to localize the high frequency portion; and combining the localized high frequency portion with the low frequency portion.

15. The method of claim 14, wherein said combining the localized high frequency portion with the low frequency portion further comprises at least one of delaying the low frequency portion and reversing the polarity of the low frequency portion.

16. The method of claim 1, further comprising:

adding a digital watermark to the stereo signal that indicates that at least one of the first channel and the second channel are localized.

17. The method of claim 1, further comprising:

receiving an additional stereo signal having a plurality of channels;

determining a digital watermark is present in the additional stereo signal; and transmitting the additional stereo signal to an output without applying a HRTF to a channel of the plurality of channels.

18. A computer program product, comprising:

a first set of instructions, stored in at least one non-transitory computer-readable storage media, executable by at least one processing unit to receive a stereo signal having a plurality of channels;

a second set of instructions, stored in at least one non-transitory computer-readable storage media, executable by at least one processing unit to apply at least a first head related transfer function (HRTF) to a first channel of the plurality of channels of the stereo signal to localize the first channel to a first particular point in space and to create virtual movement of the first channel by applying a periodic function to at least one location parameter of the at least the first HRTF;

a third set of instructions, stored in at least one non-transitory computer-readable storage media, executable by at least one processing unit to apply at least a second HRTF to a second channel of the plurality of channels of the stereo signal to localize the second channel to a second particular point in space; and a fourth set of instructions, stored in at least one non-transitory computer-readable storage media, executable by at least one processing unit to transmit the stereo signal with the localized first channel and the localized second channel to an output.

* * * * *